US006945417B2

(12) United States Patent
Jansen et al.

(10) Patent No.: US 6,945,417 B2
(45) **Date of Patent: *Sep. 20, 2005**

(54) RESEALABLE MEDICAL TRANSFER SET

(75) Inventors: Hubert Jansen, Jarrie (FR); Jean-Claude Thibault, Saint Egreve (FR)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/723,531

(22) Filed: Nov. 26, 2003

(65) Prior Publication Data

US 2004/0129343 A1 Jul. 8, 2004

Related U.S. Application Data

(63) Continuation of application No. 09/665,859, filed on Sep. 20, 2000, now Pat. No. 6,681,946, and a continuation-in-part of application No. 09/454,453, filed on Dec. 6, 1999, now Pat. No. 6,189,580, which is a continuation-in-part of application No. 09/168,502, filed on Oct. 8, 1998, now Pat. No. 6,382,442, which is a continuation of application No. 09/031,302, filed on Feb. 26, 1998, now Pat. No. 6,003,566.

(60) Provisional application No. 60/082,372, filed on Apr. 20, 1998.

(51) Int. Cl.[7] ..... B65D 39/00; B65D 41/10; B65D 47/04

(52) U.S. Cl. ..... 215/249; 141/329; 215/247; 215/251; 215/258; 215/274; 215/324; 215/DIG. 3; 604/411; 604/415; 604/416

(58) Field of Search ..... 215/249, 247, 215/251, 258, 274, 324, DIG. 3, 307, 355, 295–297, 308; 141/329, 330, 21–27; 604/403, 406, 411–416; 222/81, 83, 83.5

(56) References Cited

U.S. PATENT DOCUMENTS 37,221 A 12/1862 Dunton (Continued)

FOREIGN PATENT DOCUMENTS

CH 501 172 12/1970

(Continued)

*Primary Examiner*—Lee Young
*Assistant Examiner*—Niki M. Eloshway
(74) *Attorney, Agent, or Firm*—David M. Fortunato

(57) ABSTRACT

A transfer set for transferring fluid, including drugs, vaccines, medicaments, solutions and the like, between a first container, such as a conventional vial, and a second container, such as a conventional syringe having a unique multipurpose resealable member. The transfer set assembly includes an elastomeric tubular fluid transfer and resealable valve member preferably including an open end mounted on the pierceable closure or stopper of a vial and a generally closed distal end having a longitudinal slit and a piercing member is telescopically received within the fluid transfer valve member having a piercing end opposite the pierceable closure. The fluid transfer valve member is preferably formed of silicone and is surrounded by a generally tubular luer connector member having an open end mounted on the pierceable closure and a distal end having male luer threads. This assembly is enclosed within a cup-shaped closure and the assembly is retained to the first container or vial by a collar preferably secured to the vial by crimping. Upon removal of the cup-shaped closure, fluid communication between the vial and a second container, such as a syringe, is achieved by threading the luer connector of the syringe on the luer threads of the tubular luer connector member, which drives the tip through the slit of the elastomeric fluid transfer valve member against the distal end of the piercing member, driving the piercing end through the pierceable closure. In the preferred embodiment, the piercing member includes a generally longitudinal channel which establishes communication between the vial and the syringe through the tubular fluid transfer valve member.

8 Claims, 3 Drawing Sheets

U.S. PATENT DOCUMENTS 659,519 A 10/1900 DeOliveria
2,342,215 A 2/1944 Perelson
2,388,634 A 11/1945 DeWoody
2,524,365 A 10/1950 Smith
2,607,503 A 8/1952 Sonnenberg
2,653,609 A 9/1953 Smith
2,659,370 A 11/1953 Smith
2,667,986 A 2/1954 Perelson
2,953,132 A 3/1960 Richter
3,033,202 A 5/1962 Richter et al.
3,164,303 A 1/1965 Trautmann
3,206,080 A 9/1965 Scislowicz
3,278,063 A 10/1966 Kranzhoff
3,356,093 A 12/1967 Monahon
3,357,427 A 12/1967 Wittke et al.
3,610,297 A 10/1971 Raaf et al.
3,674,028 A 7/1972 Ogle
3,779,371 A 12/1973 Rovinksi
3,810,469 A 5/1974 Hurschman
3,826,260 A 7/1974 Killinger
3,838,689 A 10/1974 Cohen
3,872,992 A 3/1975 Larson
3,940,003 A 2/1976 Larson
3,977,555 A 8/1976 Larson
3,995,630 A 12/1976 Van De Veerdonk
4,020,839 A 5/1977 Klapp
4,048,999 A 9/1977 Kobel
4,067,440 A 1/1978 Lataix
4,153,057 A 5/1979 Kobel
4,187,893 A 2/1980 Bujan
4,210,255 A 7/1980 Pan
4,296,786 A 10/1981 Brignola
4,336,891 A 6/1982 Smith
4,387,879 A 6/1983 Tauschinski
4,412,623 A 11/1983 Schmidt
4,418,827 A 12/1983 Butterfield
4,425,120 A 1/1984 Sampson et al.
4,460,735 A 7/1984 Froix
4,493,348 A 1/1985 Lemmons
4,505,709 A 3/1985 Froning et al.
4,507,113 A 3/1985 Dunlap
4,564,054 A 1/1986 Gustavsson
4,573,506 A 3/1986 Paoletti
4,573,976 A 3/1986 Sampson et al.
4,576,211 A 3/1986 Valentini et al.
4,588,403 A 5/1986 Weiss et al.
4,619,651 A 10/1986 Kopfer et al.
4,624,393 A 11/1986 Lopez
4,639,250 A 1/1987 Rycroft
4,662,878 A 5/1987 Lindmayer
4,672,996 A 6/1987 Floyd et al.
4,673,404 A 6/1987 Gustavsson
4,792,053 A 12/1988 Towne et al.
4,822,351 A 4/1989 Purcell
4,826,491 A 5/1989 Schramm
4,834,149 A 5/1989 Fournier et al.
4,834,152 A 5/1989 Howson et al.
4,850,994 A 7/1989 Zerbet et al.
4,884,703 A 12/1989 O'Meara
4,909,290 A 3/1990 Coccia
4,913,945 A 4/1990 Maruhashi et al.
4,923,447 A 5/1990 Morgan
4,927,423 A 5/1990 Malmborg
4,932,937 A 6/1990 Gustavsson et al.
4,944,736 A 7/1990 Holtz
4,982,740 A 1/1991 Broden
5,006,118 A 4/1991 Yule
5,024,256 A 6/1991 Vadjer
5,035,689 A 7/1991 Schroeder
5,060,812 A 10/1991 Schroeder
5,088,996 A 2/1992 Kopfer et al.
5,092,840 A 3/1992 Healy
5,116,326 A 5/1992 Schmidt
5,169,385 A 12/1992 Turnball
5,171,214 A 12/1992 Kolber et al.
5,215,538 A 6/1993 Larkin
5,217,433 A 6/1993 Bunin
5,232,029 A 8/1993 Knox et al.
5,232,109 A 8/1993 Tirrell et al.
5,250,037 A 10/1993 Bitdinger
5,275,299 A 1/1994 Konrad et al.
5,279,576 A 1/1994 Loo et al.
5,291,991 A 3/1994 Meyer
5,297,599 A 3/1994 Bucheli
5,342,319 A 8/1994 Watson et al.
5,348,548 A 9/1994 Meyer et al.
5,350,372 A 9/1994 Ikeda et al.
5,352,196 A 10/1994 Haber et al.
5,358,501 A 10/1994 Meyer
5,360,413 A 11/1994 Leason et al.
5,364,386 A 11/1994 Fukuoka et al.
5,385,546 A 1/1995 Kriesel et al.
5,397,303 A 3/1995 Sancoff et al.
5,409,125 A 4/1995 Kimber et al.
5,411,499 A 5/1995 Dudar et al.
5,415,374 A 5/1995 Carroll et al.
5,419,256 A 5/1995 Pollich
5,421,814 A 6/1995 Geary
5,423,791 A 6/1995 Bartlett
5,425,465 A 6/1995 Healy
5,429,256 A 7/1995 Kestenbaum
5,433,330 A 7/1995 Yatsko et al.
5,433,703 A 7/1995 Utterberg et al.
5,435,282 A 7/1995 Haber et al.
5,437,648 A 8/1995 Graves et al.
5,441,487 A 8/1995 Vedder
5,454,409 A 10/1995 McAffer et al.
5,454,805 A 10/1995 Brony
5,466,219 A 11/1995 Lynn et al.
5,470,319 A 11/1995 Mayer
5,470,327 A 11/1995 Helgren et al.
5,474,541 A 12/1995 Ritsky et al.
5,474,544 A 12/1995 Lynn
5,487,737 A 1/1996 Meyer
5,494,170 A 2/1996 Burns
5,501,676 A 3/1996 Niedospial et al.
5,514,116 A 5/1996 Viallancourt et al.
5,514,117 A 5/1996 Lynn
5,520,641 A 5/1996 Behnke et al.
5,520,642 A 5/1996 Bigagli et al.
5,520,661 A 5/1996 Lal et al.
5,520,665 A 5/1996 Fleetwood
5,520,666 A 5/1996 Choudhury et al.
5,533,983 A 7/1996 Haining
5,533,994 A 7/1996 Meyer
5,549,651 A 8/1996 Lynn
5,566,729 A 10/1996 Grabenkort et al.
5,573,516 A 11/1996 Tyner
5,573,520 A 11/1996 Schwartz et al.
5,573,525 A 11/1996 Watson et al.
5,573,526 A 11/1996 Hess
5,576,392 A 11/1996 Yamamoto et al.
5,598,939 A 2/1997 Watson et al.
5,613,291 A 3/1997 Solomon et al.
5,616,129 A 4/1997 Mayer
5,616,130 A 4/1997 Mayer
5,620,434 A 4/1997 Brony
5,641,010 A 6/1997 Maier
5,662,230 A 9/1997 Finnneran
5,675,020 A 10/1997 McPhee
5,685,845 A 11/1997 Grimard

| | | | | | |
|---|---|---|---|---|---|
| 5,697,915 | A | | 12/1997 | Lynn | |
| 5,702,019 | A | | 12/1997 | Grimard | |
| 5,709,666 | A | | 1/1998 | Reynolds | |
| 5,718,348 | A | | 2/1998 | Manera | |
| 5,776,124 | A | | 7/1998 | Wald | |
| 5,776,125 | A | | 7/1998 | Dudar et al. | |
| 5,785,701 | A | | 7/1998 | Sams et al. | |
| 5,803,284 | A | | 9/1998 | Grimard | |
| 5,819,964 | A | | 10/1998 | Grimard | |
| 5,833,089 | A | | 11/1998 | Manni et al. | |
| 5,855,575 | A | | 1/1999 | Solomon et al. | |
| 5,857,579 | A | | 1/1999 | Finneran | |
| 5,863,655 | A | | 1/1999 | Mock | |
| 5,873,872 | A | | 2/1999 | Thibault et al. | |
| 5,879,345 | A | | 3/1999 | Aneas | |
| 5,891,129 | A | | 4/1999 | Daubert et al. | |
| 5,925,029 | A | | 7/1999 | Jansen et al. | |
| 5,931,828 | A | | 8/1999 | Durkee | |
| 5,954,104 | A | | 9/1999 | Daubert et al. | |
| 5,957,898 | A | | 9/1999 | Jepson et al. | |
| 6,003,566 | A | | 12/1999 | Thibault et al. | |
| 6,039,093 | A | | 3/2000 | Mrotzek et al. | |
| 6,042,580 | A | * | 3/2000 | Ida et al. | 215/11.4 |
| 6,050,435 | A | | 4/2000 | Bush et al. | |
| 6,056,135 | A | | 5/2000 | Widman | |
| 6,070,623 | A | | 6/2000 | Aneas | |
| 6,071,270 | A | | 6/2000 | Fowles et al. | |
| 6,139,534 | A | | 10/2000 | Niedospial, Jr. et al. | |
| 6,189,580 | B1 | | 2/2001 | Thibault et al. | |
| 6,209,738 | B1 | | 4/2001 | Jansen et al. | |
| 6,378,714 | B1 | | 4/2002 | Jansen et al. | |
| 6,382,442 | B1 | | 5/2002 | Thibault et al. | |
| 6,681,946 | B1 | * | 1/2004 | Jansen et al. | 215/249 |

FOREIGN PATENT DOCUMENTS

| | | | |
|---|---|---|---|
| DE | 3618158 | A1 | 5/1986 |
| EP | 0236127 | A2 | 3/1987 |
| EP | 0406374 | B1 | 12/1989 |
| EP | 0065469 | A2 | 5/1992 |
| EP | 0769456 | A2 | 10/1996 |
| EP | 0747293 | A1 | 12/1996 |
| FR | 950.625 | | 7/1947 |
| FR | 1.071.487 | | 2/1953 |
| FR | 1.328.635 | | 7/1962 |
| FR | 1.487.413 | | 5/1966 |
| FR | 2.395.198 | | 1/1979 |
| FR | 2738550 | | 9/1995 |
| GB | 2 121 016 | A | 6/1983 |
| WO | WO 84/04673 | | 12/1984 |
| WO | WO 88/01881 | | 3/1988 |
| WO | WO 92/11056 | | 7/1992 |
| WO | WO 94/03373 | | 2/1994 |
| WO | WO 95/00117 | | 1/1995 |
| WO | WO 95/03841 | | 2/1995 |
| WO | WO 95/14176 | | 5/1995 |
| WO | WO 95/31242 | | 11/1995 |
| WO | WO 95/33505 | | 12/1995 |
| WO | WO 95/35125 | | 12/1995 |
| WO | WO 96/13301 | | 5/1996 |
| WO | WO 97/00702 | | 1/1997 |
| WO | WO 97/10156 | | 3/1997 |
| WO | WO 97/39720 | | 10/1997 |
| WO | WO 98/13006 | | 4/1998 |
| WO | WO 98/32411 | | 7/1998 |
| WO | WO 98/37853 | | 9/1998 |
| WO | WO 98/37854 | | 9/1998 |

* cited by examiner

RESEALABLE MEDICAL TRANSFER SET

RELATED APPLICATIONS

This application is a continuation of U.S. patent application Ser. No. 09/665,859, filed on Sep. 20, 2000, now U.S. Pat. No. 6,681,946 which is a continuation-in-part of U.S. patent application Ser. No. 09/168,502, filed on Oct. 8, 1998, now U.S. Pat. No. 6,382,442, which claims priority under 35 U.S.C. §119(e) to U.S. Provisional Patent Application No. 60/082,372, filed on Apr. 20, 1998, and is a continuation-in-part of U.S. patent application Ser. No. 09/454,453, filed on Dec. 6, 1999, now U.S. Pat. No. 6,189,580, which is a continuation of U.S. patent application Ser. No. 09/031,302, filed on Feb. 26, 1998, now U.S. Pat. No. 6,003,566, all of which are incorporated herein by reference.

FIELD OF THE INVENTION

This invention relates to an improved universal resealable transfer set for transferring fluid, including drugs, vaccines, medicaments, solutions and the like, between a first container, such as a conventional vial having a pierceable elastomeric closure or stopper, and a second container, such as a conventional syringe having a luer connector. The transfer set assembly includes a fluid transfer member having a resealable valve member which permits repeated use of the transfer set for transferring fluid between the first and second containers.

BACKGROUND OF THE INVENTION

It is conventional to store drugs, vaccines, solutions and medicaments in a sealed vial or other container for later use. Such materials may be in a dry or powdered form to increase the shelf life and reduce inventory space. Such dry or powdered materials may be stored in a conventional sealed vial having an elastomeric stopper and reconstituted in liquid form for administration to a patient by adding a diluent or solvent. Alternatively, the material may be stored in liquid or even a gaseous form. A conventional vial for storing drugs, vaccines, medicaments and the like, generally includes an open end, a radial rim portion surrounding the open end and a reduced diameter neck portion adjacent the rim portion. The vial is conventionally sealed with an elastomeric stopper which generally includes a generally tubular portion inserted into the neck of the vial and a planar rim portion which overlies the vial rim. The stopper is normally secured to the vial with a thin malleable metal cap, such as aluminum. Because aluminum is malleable, the collar accommodates the buildup of tolerances of the dimensions of the stopper and vial rim. The dimensions and tolerances of standard vials and stoppers are set by the International Standards Organization (ISO).

Recently, various vial transfer sets have been proposed for transferring fluid between a vial and a conventional syringe wherein the transfer set is mounted on the vial for later use. The proposed transfer sets, however, do not permit multiple uses of the transfer set, limiting their use to one application. The transfer set may include a piercing member, such as a needle cannula, generally telescopically mounted in a tubular fluid transfer member mounted on the open end of the vial. The transfer set may be enclosed by cup-shaped closure having a radial flange portion secured to the vial by malleable metal or plastic collar. Examples of such improved transfer sets include U.S. Pat. No. 6,003,566 assigned to the assignee of this application and pending application Ser. No. 09/168,502, filed Oct. 8, 1998 assigned to the assignee of this application, the disclosures of which are hereby incorporated by reference in their entirety.

As set forth above, however, the prior proposed vial transfer sets are not resealable and are therefore limited to a single use. U.S. Pat. Nos. 5,474,544, 5,549,651 and 5,697,915 disclose luer receiving medical valves having a slit silicone membrane and which eliminates the requirement for a needle cannula on the syringe, sometimes referred to as a "luer slip connector." The medical valve disclosed in these patents are not, however, readily adaptable to a transfer set because the longitudinally slit cylindrical polymeric membrane must first be moved within the valve to a larger diameter chamber and then compressed by the luer slip connector of the syringe to expand and open the slit for transfer of fluid. Further, the luer receiving medical valve disclosed in these patents do not provide for piercing of a closure, such as the pierceable stopper of a conventional vial.

The need therefore remains for a universal transfer set suitable for use with a conventional sealed vial for transfer of fluids between a vial and a second container, such as a conventional syringe, whereby the transfer set is resealable for multiple applications. The resealable transfer set of this invention fulfills this need in a simple, reliable design, which is easily used by a healthcare worker. The resealable transfer set of this invention can be utilized to transfer fluids between a conventional vial having a conventional elastomeric stopper and a conventional syringe without a needle cannula. However, the improved resealable transfer set of this invention is universal in that it can be used to transfer any fluid between a first container having a pierceable closure and a second container.

SUMMARY OF THE INVENTION

As set forth above, the resealable transfer set of this invention may be utilized for transferring fluid between a first container having a pierceable closure, such as a conventional vial having an elastomeric stopper, and a second container, such as a conventional syringe without requiring a needle cannula. The transfer set includes a unique generally tubular elastomeric fluid transfer valve member, preferably molded of sterilizeable silicone, including an open end portion coaxially aligned with the container opening and a generally closed distal end portion having a longitudinal slit therethrough. A piercing member is telescopically received in the fluid transfer valve member through the open end including a piercing end adjacent the pierceable closure of the first container and a distal end adjacent the generally closed end of the fluid transfer valve member opposite and most preferably adjacent the longitudinal slit. For ease of description, the portions of the transfer set adjacent the pierceable closure or elastomeric stopper are referred to as "proximate" and the portions remote from the pierceable closure are referred to as "distal."

Fluid may then be transferred between the first container and the second container by driving a tubular portion of the second container through the slit in the distal end of the elastomeric fluid transfer valve member against the piercing member, which drives the piercing end through the pierceable closure. Although the resealable transfer set of this invention may be utilized for transferring fluids between various containers, and is therefore not limited to the types of containers utilized, one important advantage of the resealable transfer set of this invention is that it may be utilized to transfer fluids between a conventional vial sealed with a conventional elastomeric stopper and a conventional syringe having a luer slip connector. Thus, the resealable fluid transfer set will now be described for use with a conventional vial and syringe for ease of description.

The preferred embodiment of the tubular connector member includes a male luer connector at its distal end which receives the luer connector of a conventional syringe having a female luer connector. Threading of the luer connector of the syringe on the luer connector of the tubular luer connector member drives the tubular end of the syringe through the longitudinal slit against the distal end of the piercing member, driving the piercing end through the elastomeric stopper and establishing fluid communication between the syringe and the vial. In the preferred embodiment, the piercing member includes a generally longitudinal channel, establishing fluid communication between the vial and the syringe through the generally tubular elastomeric fluid transfer valve member. In the most preferred embodiment, the free distal end of the elastomeric fluid transfer valve member includes a radial annular lip portion which is received over the distal end of the generally tubular luer connector member, supporting and retaining the tubular elastomeric fluid transfer member. Further, the generally tubular elastomeric fluid transfer valve member includes an outwardly tapered or conical enlarged tubular portion adjacent the generally closed distal end portion which is generally hourglass-shaped and the distal end of the piercing member includes an enlarged conical head portion, such that the piercing member is releasably retained in the elastomeric fluid transfer valve member during assembly and prior to use. The preferred embodiment of the generally tubular luer connector member then includes a lateral opening or openings which permits lateral expansion of the conical portion of the fluid transfer valve member and release of the piercing member.

Upon removal of the tubular portion of the syringe or second container from the longitudinal slit in the generally closed distal end portion of the fluid transfer valve member, the slit closes effectively resealing the transfer set for later use. All that is required for later reuse is to swab the surface of the exposed closed distal end with a suitable sterilizing fluid. Thus, the resealable transfer set of this invention is suitable for multiple uses, permitting storage of a greater quantity of medicament in the vial.

The preferred embodiment of the resealable transfer set of this invention further includes a cup-shaped closure surrounding the luer connector member including an open end having a radial flange portion mounted on the vial by a collar, such as a conventional malleable aluminum collar or an improved plastic collar as disclosed in the above-referenced U.S. Pat. No. 6,003,566, the disclosure of which is incorporated herein by reference. The cup-shaped closure surrounds the generally tubular luer connector member and the elastomeric fluid transfer valve member and includes a closed distal end. In a most preferred embodiment, the collar includes a first proximate tubular portion which is received around the radial flange portion of the closure, the planar rim portion of the elastomeric stopper and the rim of the vial including a free end deformed or otherwise received in the neck portion of the vial, and a second distal tubular portion which surrounds the proximate tubular portion of the closure or cap and the closure includes a frangible portion located within the second distal tubular portion of the collar. The closure is then removed by breaking the frangible connection, exposing the generally closed distal end portion of the fluid transfer valve member for receipt of the tubular portion of a syringe or other container.

As described more fully in the above-referenced co-pending patent application Ser. No. 09/168,502, the plastic collar or closure may be formed of a polymer alloy or melt blend which includes a relatively tough soft malleable co-polymer and a relatively rigid polymer, such that the free end of the proximate tubular portion may be deformed or crimped into the reduced diameter neck portion of the vial. The preferred relatively rigid polymer is a polyamid or a polycarbonate and the preferred relatively soft co-polymer may be selected from polyesters or polyolefins. The resultant polymer alloy or composite preferably has an elongation that yield between 5% and 10% and an elongation at break greater than 100% with a flectural modulus of greater than 1900 MPa. Suitable polymers for the plastic collar of the transfer set of this invention include EASTAR® MB polymers, which are melt blend and alloy polymers and EASTAR® thermoplastic polymers, which are neat polymers sold by Eastman Chemical Company of Kingsport, Tenn. and Eastman Chemical AG of Zug, Switzerland under the tradenames "DA003," "DN003" and "DN004." Other polymers having similar properties will also be suitable for this application. Alternatively, the collar may be formed of a malleable metal, such as aluminum, as disclosed in the above-referenced U.S. Pat. No. 6,003,566.

The transfer set of this invention may be assembled prior to application to a vial by telescopically receiving the piercing member in the generally tubular elastomeric fluid transfer valve member, which is releasably retained in the fluid transfer valve member as described above. The fluid transfer valve member and piercing member may then be inserted into the generally tubular luer connector member, which is retained in place by the radial annular lip portion described above, and the assembly received in the cup-shaped closure and collar which, in the disclosed embodiment, is retained to the closure by lip received in a groove in the collar.

The transfer set assembly of this invention is resealable and suitable for multiple uses as described above and the design is relatively simple and may be manufactured at relatively low cost. The transfer set assembly is also reliable and simple to use for transferring fluids between a vial and a syringe by healthcare workers. Other advantages and meritorious features of the present invention will be more fully understood from the following description of the preferred embodiments, the appended claims and the drawings, a brief description of which follows.

DETAILED DESCRIPTION OF THE PREFERRED EMBODIMENTS

Figure 1:
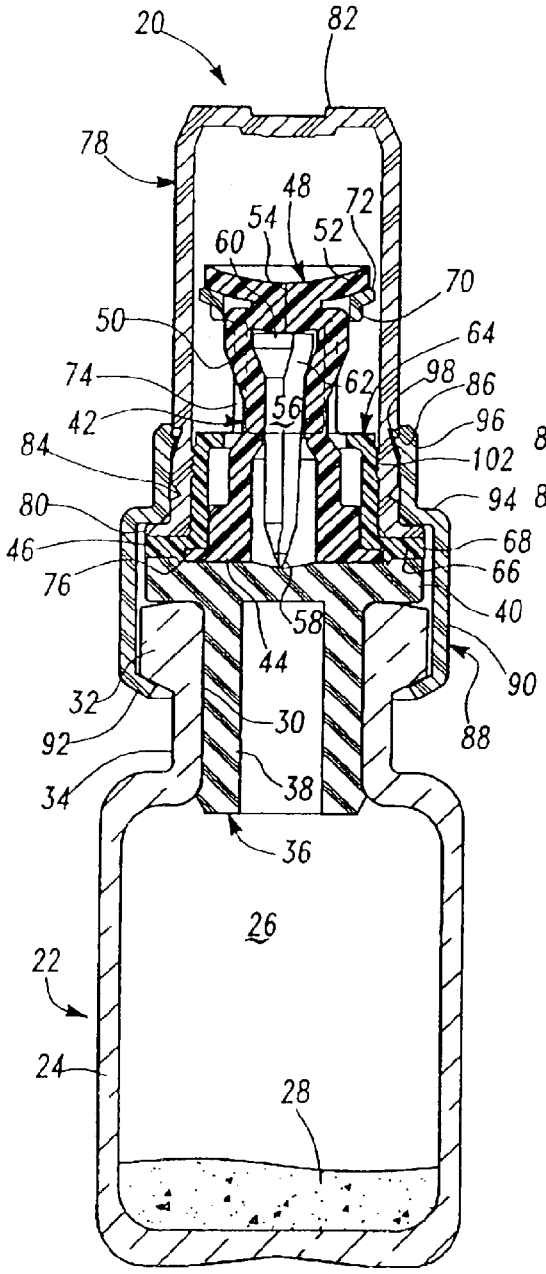
FIG. 1 is a side cross-sectional view of a preferred embodiment of the resealable transfer set of this invention assembled on a conventional vial.

As described above, the preferred embodiments of the resealable transfer set assembly 20 of this invention may be utilized with a conventional vial 22, typically formed of glass, but may also be formed of plastic. A typical medicament vial 22 includes a body portion 24 defining an enclosure 26 which may receive dry or powdered medicament or drug for later reconstitution in liquid form by adding a diluent or solvent. The vial further includes an open end 30, a rim portion 32 surrounding the open end of the vial and a reduced diameter neck portion 34 adjacent the rim portion. Medicament vials are typically sealed with an elastomeric stopper 36 which may be formed of natural or synthetic rubber. A typical elastomeric stopper includes a tubular portion 38 having a diameter slightly greater than the internal diameter of the opening 30 to provide a good seal, and a planar rim portion 40 which overlies the rim portion 32 of the vial. As described above, however, the transfer set 20 of this invention may be utilized to sealingly transfer fluids between various containers and the transfer set of this invention is not limited to a particular container, such as the disclosed conventional vial.

The improved resealable transfer set of this invention includes a unique generally tubular elastomeric fluid transfer valve member 42 preferably formed of a resilient sterilizeable plastic, such as silicone. The transfer valve member includes a proximate open end portion 44 which is mounted on the planar portion 40 of the elastomeric stopper 36 in coaxial alignment with the opening 30 of the vial 22. The proximate open end portion 44 includes a radial annular rim 46 which nests into the generally tubular luer connector member 64 described below. The fluid transfer valve member 42 further includes a generally closed distal end portion 48 having a longitudinal slit 54 for providing communication through the end portion 48 as described below. As shown in FIG. 1, the preferred embodiment of the fluid transfer valve member 42 is hourglass-shaped, including an outwardly tapered or conical enlarged tubular portion 50 which releasably retains the piercing member 56 as described below. In the preferred embodiment, the generally closed distal end portion 48 of the fluid transfer valve member 42 further includes a generally radial annular lip portion 52 which overlies the distal end of the generally tubular luer connector member 64 described below. It should also be appreciated that the valve member 42 be in the form of a thin plastic film or a multi-layer membrane sealed to the luer connecting member. Also, the longitudinal slit 54 may be in the form of a pre-pierced portion to accommodate a needle or simply pierceable closed membrane or the like in the event the piercing member includes a double ended cannula.

A piercing member 56 is telescopically received through the proximate open end portion 44 of the fluid transfer valve member 42. The piercing member 56 includes a relatively sharp piercing end 58, and an enlarged conical distal head 60 which is releasably retained in the outwardly tapered conical portion 50 of the resilient fluid transfer valve member 42 as discussed further below. The disclosed embodiment of the piercing member 56 further includes a longitudinal V-shaped channel 62 providing communication between the interior 26 of the vial and a second container as described below. As will be understood, however, the channel 62 may be of various shapes and configurations including, for example, a discontinuous channel or a longitudinal passage.

The preferred embodiment of the improved resealable transfer set assembly 20 of this invention further includes a generally tubular luer connector member 64 which surrounds the fluid transfer valve member 42 as shown. The luer connector member includes an open proximate end portion 66, which is generally coaxially aligned with the opening 30 in the vial, having a radial rim portion 68 overlying the planar rim portion 40 of the elastomeric stopper. The luer connector member further includes an open distal end 70 having male luer threads 72 which interconnects the vial to a second container, such as a conventional syringe, as described below. The preferred embodiment of the luer connector member 64 further includes a lateral or transverse opening or openings 74 which permit the outwardly tapered conical portion 50 of the fluid transfer valve member to expand and release the enlarged conical head 60 of the piercing member 56 as described below. In the preferred embodiment of the luer connector member 64, the radial rim portion 66 includes an annular barb 76 which bites into the radial rim portion 40 of the elastomeric stopper, preventing leakage.

The transfer valve member 42 and luer connector member 64 are enclosed and hermetically sealed in the disclosed embodiment by a cup-shaped closure or cap 78. The closure or cap includes a radial rim portion 80 which overlies the radial rim portion 68 of the luer connector member 64 and a closed distal end 82. The disclosed embodiment of the closure 78 further includes a weakened frangible portion 84 in the form of a V-shaped groove and a second groove 86 which receives the radial rib 98 of the collar 88 as described below.

Figure 3:
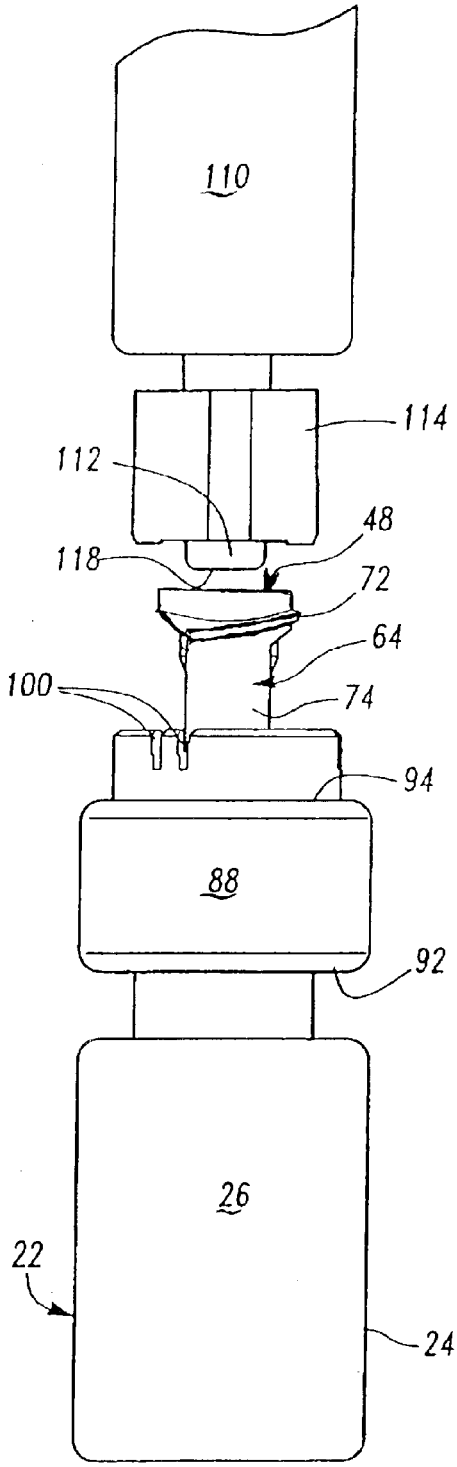
FIG. 3 is a side view of the transfer set assembly following removal of the closure ready for receiving the tubular portion of a syringe.

The transfer set assembly is secured to the rim portion 32 of the vial in the disclosed embodiment by a plastic collar 88 which may be formed of a polymer alloy or melt blend as described above. The collar 88 includes a proximate tubular portion 90 which surrounds the radial rim portions 68 and 80 of the tubular luer connector member 64 and the cup-shaped closure 78, respectively, the planar rim 40 of the stopper and the neck 32 of the vial. The free end 92 of the proximate tubular portion 90 is deformed or crimped into the neck portion 34 of the vial. The collar 88 further includes a radial portion 94 overlying the radial rim portion 80 of the closure and a distal tubular portion 96 which overlies the proximate portion of the closure including the V-shaped groove 84, protecting the frangible portion prior to use. The free end of the distal tubular portion 96 further includes a radial rib 98 which snaps into the second annular groove 86, retaining the collar 88 on the cap following assembly of the resealable transfer set assembly, prior to assembly on the vial. The distal tubular portion 96 may include a plurality of axial grooves 100, as shown in FIG. 3, such that the internal diameter of the distal tubular portion 96 of the collar is approximately equal to the external diameter of the cap and the rib then snaps into the second annular groove 86 during assembly. The internal surface of the closure 78 may also include a plurality of ribs 102 which may include a sealant such as silicone grease to further ensure sealing between the luer connector member and the cap.

Figure 2:
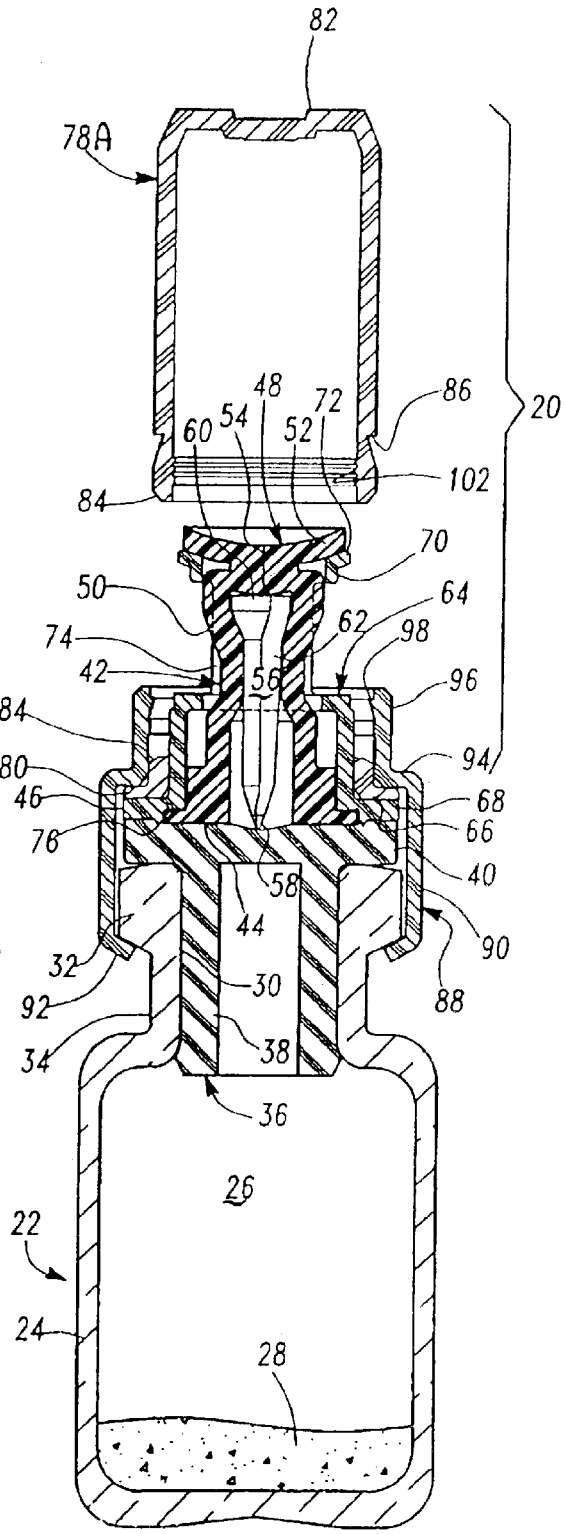
FIG. 2 is a side cross-sectional view similar to FIG. 1 following removal of the cup-shaped closure.
Figure 4:
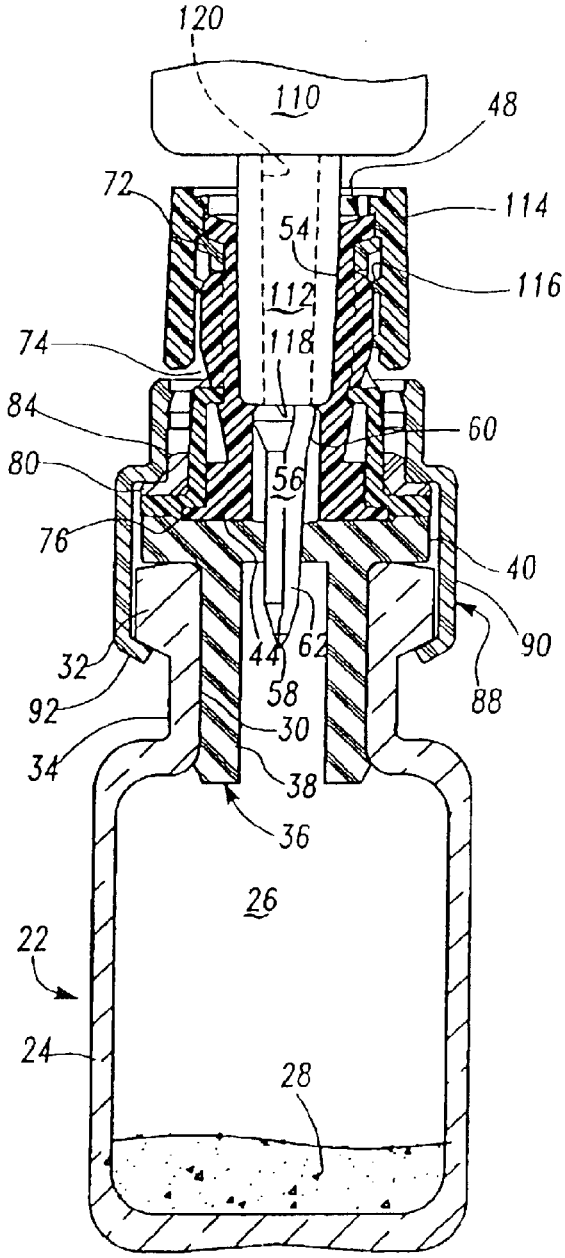
FIG. 4 is a side partially cross-sectioned view of the transfer set and vial assembly shown in FIGS. 1 and 2 following threaded securement of the syringe on the transfer set.

Having described the components of the improved resealable transfer set assembly 20 of this invention, the operation and use may now be described. The first step is to remove the distal portion 78A of the cap as shown in FIG. 2. This is accomplished by grasping the cap and twisting or turning, thereby breaking the weakened frangible portion 84. The transfer set is then ready for use as shown in FIG. 3. As described above, the transfer set assembly of this invention may be utilized with a conventional syringe 110 having a tubular projecting tip 112 and a female luer connector 114. The female luer connector 114 includes female threads 116 which thread onto the male luer threads 72 as shown in FIG. 4. Threading of the female luer connector 114 onto the luer connector 72 on the open distal end 70 of the luer connector member 64 fully drives the tubular tip or end 112 of the syringe through the slit 54 of the elastomeric fluid transfer valve member 42 as shown in FIG. 4. As will be understood, the longitudinal slit 54 is spaced from the opposed sides of the generally closed distal end portion 48 of the transfer valve member to prevent splitting of the transfer valve member. But the length of the slit will depend upon the diameter of the tubular tip 112. The free end 118 of the tubular tip 112 is then driven against the distal end 60 of the piercing member 56, driving the piercing end 58 of the piercing member through the planar rim portion 40 of the elastomeric stopper 36. Fluid communication is thus established between the interior 26 of the vial 22 through the channel 62 of the piercing member into the port 120 of the tubular tip portion 112 of the syringe. Alternatively, a needle cannula may be utilized in place of the piercing member upon opening of the valve.

Figure 5:
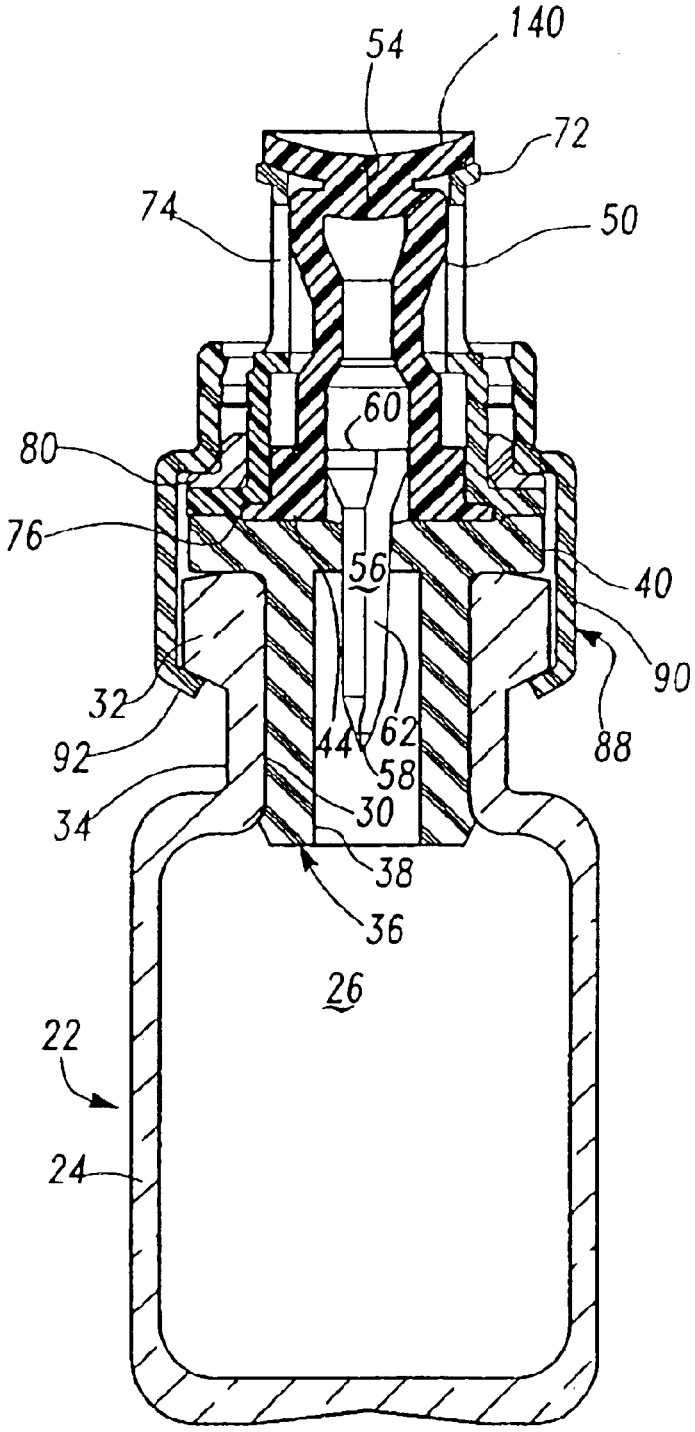
FIG. 5 is a side cross-sectional view similar to FIG. 4 following removal of the syringe.

Upon withdrawal of the tip 112 of the syringe 110 or other conduit or container as shown in FIG. 5, the longitudinal slit 54 recloses or seals; however, the medication in the vial remains ready for use. It is recommended, however, that the end surface 140 be swabbed with a suitable sterilization solution prior to reuse. An example of the use of the resealable transfer set assembly of this invention is as follows. As set forth above, the vial 22 may contain a dry or powdered medicament or drug. The drug may be reconstituted by adding a diluent or solvent from a syringe by removing the portion 78A of the cap as shown in FIG. 2. A solvent or diluent is then added to the dry or powdered medicament or drug 28 by threading the luer connector 114 onto the luer connector 72 of the luer connector member 64 as shown in FIG. 4 and the solvent or diluent is added to the dry or powdered medicament by driving the plunger (not shown) of the syringe. The assembly is then turned upside down and shakened to reconstitute the drug. A portion of the liquid reconstituted drug may then be removed by withdrawing the plunger (not shown) of the syringe. Further reconstituted drug or medicament may be removed at a later time for further application to a patient. The resealable transfer set of this invention therefore permits removal of several applications of the reconstituted drug or medicament, thereby taking advantage of the shelf life of dry or powdered drugs or medicaments while permitting several applications of the reconstituted drug or medicament.

The transfer set of this invention therefore fulfills the need for a resealable transfer set for multiple applications of a drug or medicament in a simple low cost design. Further, the resealable transfer set of this invention is reliable and simple to use by a healthcare worker. The transfer set assembly also eliminates the need for using a needle cannula for reconstituting a drug. As will be understood by those skilled in the art, various modifications may be made to the improved resealable transfer set of this invention within the purview of the appended claims. For example, the plastic collar 88 may be replaced with a malleable metal collar, such as aluminum.

What is claimed is:

1. A resealable transfer set for transferring fluid between a first container having an opening sealed with a pierceable closure and a second container, said transfer set comprising: a generally tubular elastomeric fluid transfer valve member mounted on said first container having an open end portion generally coaxially aligned with said opening of said first container and a generally closed portion spaced from said open end portion having a longitudinal slit therethrough, said longitudinal slit being biased to a closed position, and a piercing member telescopically received within said fluid transfer valve member between said open end portion and said generally closed portion generally coaxially aligned with said first container opening, said piercing member having a first relatively sharp piercing end portion opposite said pierceable closure and a second distal end portion opposite said generally closed portion of said transfer valve member, whereby a generally tubular portion of said second container may be driven through said slit in said generally closed portion of said fluid transfer valve member against said second distal end portion of said piercing member, driving said first piercing end portion of said piercing member through said pierceable closure and establishing fluid communication between said first and second containers, wherein said generally tubular elastomeric fluid transfer valve member includes an outwardly tapered tubular portion adjacent said generally closed portion and said piercing member second distal end portion is enlarged to be closely received in said outwardly tapered tubular portion of said fluid transfer valve member releasably retaining said piercing member in said fluid transfer valve member, wherein said transfer set includes a generally tubular luer connector member surrounding said fluid transfer valve member having a lateral opening adjacent said outwardly tapered tubular portion of said elastomeric fluid transfer valve member, permitting said outwardly tapered tubular portion to expand laterally and release said distal end portion of said piercing member.

2. The resealable transfer set defined in claim 1, wherein said piercing member includes a generally longitudinally extending external channel establishing fluid communication between said first and second containers through said fluid transfer valve member.

3. The resealable transfer set defined in claim 1, wherein said generally tubular luer connector member generally surrounding said fluid transfer valve member has a first proximate open end portion mounted on said first container and said lateral opening of said generally tubular luer connector, member having a luer threaded portion.

4. The resealable transfer set defined in claim 3, wherein said generally closed portion of said fluid transfer valve member includes a generally radial annular lip portion overlying a distal end portion of said generally tubular luer connector member retaining and supporting a distal end of said fluid transfer valve member on said first container.

5. The resealable transfer set defined in claim 3, wherein said transfer set includes a cup-shaped closure surrounding said generally tubular luer connector member having an open end mounted on said first container and a closed distal end.

6. The resealable transfer set defined in claim 1, wherein said transfer set includes a cup-shaped closure surrounding said fluid transfer valve member having an open end mounted on said first container and a closed distal end.

7. The resealable transfer set defined in claim 6, wherein said transfer set includes a collar having a first proximate tubular portion surrounding said open end portion of said fluid transfer valve member mounting said fluid transfer set on said first container and a second distal tubular portion surrounding a portion of said cup-shaped closure adjacent said open end of said closure.

8. The resealable transfer set defined in claim 7, wherein said closure includes a frangible portion surrounded by said second distal tubular portion of said collar.

* * * * *